US008950118B2

(12) United States Patent
Kuivila

(10) Patent No.: US 8,950,118 B2
(45) Date of Patent: Feb. 10, 2015

(54) GATE ADJUSTMENT SYSTEM

(76) Inventor: Richard P. Kuivila, Lone Tree, CO (US)

( * ) Notice: Subject to any disclaimer, the term of this patent is extended or adjusted under 35 U.S.C. 154(b) by 29 days.

(21) Appl. No.: 13/374,193

(22) Filed: Dec. 15, 2011

(65) Prior Publication Data

US 2012/0151715 A1 Jun. 21, 2012

Related U.S. Application Data

(60) Provisional application No. 61/459,588, filed on Dec. 15, 2010.

(51) Int. Cl.
*E05F 7/06* (2006.01)
*E05F 7/00* (2006.01)

(52) U.S. Cl.
CPC ..... *E05F 7/005* (2013.01)
USPC ..... 49/396; 49/381

(58) Field of Classification Search
USPC ..... 49/381, 396, 394; 292/340, DIG. 29, 292/DIG. 39; 33/542, 544.4
See application file for complete search history.

(56) References Cited

U.S. PATENT DOCUMENTS

| | | | | |
|---|---|---|---|---|
| 386,469 | A * | 7/1888 | Hilton | 33/806 |
| 1,991,517 | A * | 2/1935 | Perry | 49/460 |
| 4,861,099 | A * | 8/1989 | Sasamura et al. | 296/202 |
| 5,365,697 | A * | 11/1994 | Vanderpan | 49/380 |
| 6,672,021 | B2 * | 1/2004 | Kusano et al. | 52/211 |
| 6,732,475 | B1 * | 5/2004 | Lee | 49/505 |
| 7,188,430 | B2 * | 3/2007 | Tange | 33/544.4 |
| 7,654,107 | B2 * | 2/2010 | Okuda et al. | 62/441 |
| 2005/0138956 | A1 * | 6/2005 | Okuda et al. | 62/441 |
| 2008/0168715 | A1 * | 7/2008 | Titus | 49/353 |
| 2012/0025471 | A1 * | 2/2012 | Andrick et al. | 277/314 |

* cited by examiner

*Primary Examiner* — Katherine Mitchell
*Assistant Examiner* — Shiref Mekhaeil

(57) ABSTRACT

A gate adjustment system has a bull-nose glide, a flat glide, a plurality of spacers, a gap size gauge, and a gap adjustment wedge. The glides are attached to the latch post and the latch side of a gate opposite one another. As the gate is shut, the bull-nose portion of the bull-nose glide impacts the rounded edge of the flat glide. The two curved surfaces allow the impact force to cause the gate to be lifted and pushed back into alignment. The gap adjustment wedge can be positioned between the top of the latch side and the latch post and pushed downwards into the gap until the gap is uniform from the top to the bottom. The gap size gauge then measures the size of the gap and that measurement is used to determine which of the plurality of spacers should be installed with the glides.

11 Claims, 8 Drawing Sheets

GATE ADJUSTMENT SYSTEM

CROSS-REFERENCE TO RELATED APPLICATIONS

The application claims benefit of U.S. Provisional Application No. 61/459,588 entitled "Gate Adjustment System" and filed on Dec. 15, 2010, which is specifically incorporated by reference herein for all that it teaches and discloses.

TECHNICAL FIELD

The invention relates generally to fencing, gates, and gate hardware, and more particularly to a system for adjusting gates.

BACKGROUND

There are many known types of gates. They vary across a wide spectrum of forms, shapes, sizes, etc. Nevertheless, a standard gate will generally be rectangular in shape and have two primary vertical components (a hinge side and a latch side) and two primary horizontal components (an upper edge and a lower edge). The hinge side is usually attached by one or more hinges to a fence, building, vertical post, etc. (hereafter, a "hinge post"). The hinges allow the gate to swing in an arc relative to the hinge post, usually through approximately ninety degrees of travel (although often up to one hundred and eighty degrees or more).

Opposite the hinge side is the latch side of the gate. As its name implies, the latch side usually has some type of latch attached thereto that allows the gate to be secured in a closed position. The latch side of a standard gate closes against or in proximity to an upright post or similar vertical surface (hereafter, a "latch post"). When properly installed, a uniform gap is left between the latch side of the gate and the upright latch post so that the gate can open and close easily without some portion of the latch side rubbing or catching on some portion of the latch post. This gap is called a latch post gap.

Running horizontally between the hinge side and the latch side (and generally perpendicular thereto) are the upper and lowers edges of the gate. These components form the main structure of the gate and determine the overall length of the gate. Together, the two edges and two sides form the rectangular shape that defines most standard gates. Such gates can be commonly found, for example, on fences surrounding residential properties. Of course, there are many other shapes and forms for gates and the present invention is applicable to many more types than just a standard gate.

Regardless of the particular type of gate, there is one more or less ubiquitous problem that any given gate will, almost invariably, suffer eventually: gate sag. Gate sag usually occurs because of the force of gravity acting on the gate. As gravity slowly pulls down the latch side, the hinge side usually stays generally in place because it is attached to a supporting structure by the hinges. Thus, the rectangle that previously defined the shape of the gate becomes deformed as the angles between the sides and the edges are forced out of ninety degrees. As the latch side continues to be drawn downwards by gravity, the latch post gap narrows and one portion (usually the upper end) of the latch side begins to contact the latch post. Over time, the contact can be become quite extreme, such that the gate is difficult to open and almost impossible to close, as the latch side no longer fits inside the latch post.

A number of devices are known in the art that attempt to address this problem. One common device uses a support wire that extends from the top of the hinge post across to the latch side of the gate. The support wire is under tension such that the latch side is supported and should not sag, in theory, under the affects of gravity. However, not only does the support wire often fail to completely forestall gate sag, it also disrupts the aesthetic appearance and look of the gate. Additionally, it can be extremely difficult to retro-fit an existing gate with a support wire once the gate begins to sag. Another device known in the art uses an adjustable tension gate bracket (see U.S. Pat. No. 6,751,906 to Bass). This device suffers from similar deficiencies as the support wire mentioned above. Other external support structures, such as the chain device disclosed by Harris in U.S. Pat. No. 4,468,888, are also known but suffer similar problems.

Thus, there remains a need for a gate adjustment system that can prevent, correct, or otherwise mitigate gate sag and can reduce the force or effort necessary to close a gate which has already sagged.

SUMMARY

One embodiment of the present invention is a gate adjustment system comprising a bull-nose glide, a flat glide, a plurality of spacers, a gap size gauge, and a gap adjustment wedge. The two glides are attached to the latch post and the latch side of the gate opposite one another. Either glide can be attached to either location, but it is preferable to attach the bull-nose glide to the latch side of the gate. A preferred attachment location is near the top of the latch side, preferably above the latch itself. The glides are positioned so that as the gate is shut, the bull-nose portion of the bull-nose glide impacts the rounded edge of the flat glide. The two curved surfaces allow the impact force to be spread out and cause the gate to be lifted and pushed back towards the hinge side and into alignment.

The gap adjustment wedge is used during the initial installation procedure. With the gate closed, the gap adjustment wedge is positioned between the top of the latch side and the latch post—the gate can be lifted and the gap adjustment wedge pushed deeper into the gate gap until the gap is uniform from the top to the bottom. Once a uniform gap measurement is achieved, the gap size gauge should be employed. This device is placed within the gap and is used to compare the size of the gap compared to a plurality of known measurements. In another embodiment, other means of measuring the gap can be used.

Before removing the gap adjustment wedge, a straight, horizontal line can be drawn across both the latch side and the latch post in order to indicate the desired location for installation of the glides. The wedge can be removed and the gate at least partially opened so that the inner surfaces of both the latch side and latch post can be accessed for installation of the glides. Either glide can be installed on either the latch post or the latch side. Installation involves securing the glides to the latch post and latch side so that the rounded bull-nose of the bull-nose glide impacts the rounded edge of the flat glide as the gate is swung shut. As the two rounded surfaces come together, they slide over one another and cause the gate to be lifted and pushed such that the latch side fits within the gate opening and a constant latch post gap is produced. As the gate comes to rest in the appropriate position, the two glides are resting against one another. If the latch post gap that was previously measured is larger than the width of the two glides then one or more spacers can be placed between the glide(s) and the latch post/latch side during installation, as necessary.

If the present invention is installed on a new gate or on a gate that has not yet begun to suffer from gate sag, the contact between the two glides will be minimal during the gate closing procedure. However, once closed, the glides will be in contact in order to take the stresses off of the hinges and the gate itself and thereby keep gate sag from developing. Therefore, a goal of the present invention is to forestall the development of gate sag in new or otherwise solid gates. Another goal of the present invention is to allow gates that have already begun to succumb to gate sag to be more easily closed and to forestall further deterioration.

BRIEF DESCRIPTION OF THE DRAWINGS

The aforementioned and other features and objects of the present invention and the manner of attaining them will become more apparent and the invention itself will be best understood by reference to the following descriptions of a preferred embodiment and other embodiments taken in conjunction with the accompanying drawings, wherein.

DETAILED DESCRIPTION

Figure 1A:
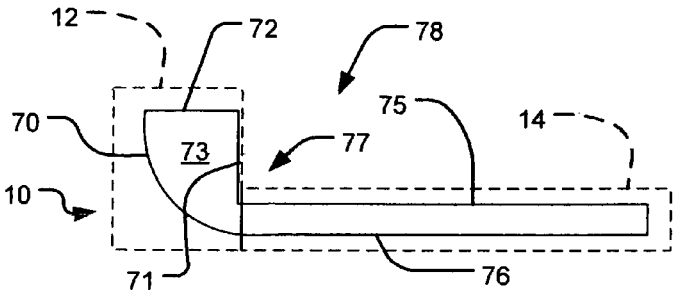
FIGS. 1A-1F each illustrate a top plan view of a component of an exemplary embodiment of a gate adjustment system.

Referring now to the drawings, exemplary embodiments of the invention are described below in the accompanying Figures. The following detailed description provides a comprehensive review of the drawings in order to provide a thorough understanding of, and an enabling description for, these embodiments. One having ordinary skill in the art will understand that the invention may be practiced without certain details. In other instances, well-known structures and functions have not been shown or described in detail to avoid unnecessarily obscuring the description of the embodiments.

FIGS. 1A-1F each illustrate a top plan view of a component of an exemplary embodiment of a gate adjustment system. The components shown in FIGS. 1A-1F include a bull-nose glide 10, a flat glide 20, a plurality of spacers 30 and 40 (including a first spacer 30 and a second spacer 40), a gap adjustment wedge 50, and a gap size gauge 60.

The bull-nose glide 110 has a curved, bull-nose portion 112 and a first mounting block portion 114. The broken-line rectangle labeled "112" surrounds and defines the curved, bull-nose portion 112. The curved, bull-nose portion 112 is shaped so as to distribute the impact forces when the gate is closed and redirect those forces into lifting and pushing the gate back into alignment rather than just having the latch side of the gate impact, and likely bounce off of, the latch post.

The approximately ninety degree angled portion of the bull-nose portion 112 is designed to wrap around the inside and back face of the latch side of a gate. Alternatively, the angled portion can be wrapped around the inside and front face of the latch post. In either case, the majority of the bull-nose portion 112 resides outside of the gate gap (i.e., the space between the latch side of the gate and the upright latch post) when the gate is closed.

The broken-line rectangle labeled "14" surrounds and defines the first mounting block portion 14 of the bull-nose glide 10. The first mounting block portion 14 is placed against either the inside of the latch post or the inside of the latch side and affixed thereto. When the gate is closed, the first mounting block portion 14 resides within the gate gap. Exemplary placement of the bull-nose glide 10 on a gate assembly can be seen in FIG. 3.

Operating in concert with the bull-nose glide 110 is the flat glide 120. The flat glide 120 has a curved portion 122 and a second mounting block portion 124. The broken-line rectangle labeled "122" surrounds and defines the curved, portion 122. The curved portion 122 is shaped so as to distribute the impact forces when the gate is closed and redirect those forces into lifting and pushing the gate back into alignment rather than just having the latch side of the gate impact, and likely bounce off of, the latch post.

The broken-line rectangle labeled "124" surrounds and defines the second mounting block portion 124 of the flat glide 120. The second mounting block portion 124 is placed against either the inside of the latch post or the inside of the latch side and affixed thereto. Exemplary placement of the flat glide 120 on a gate assembly can be seen in FIG. 3.

The bull-nose portion has a curved bull-nose front face 70, a generally flat planar first rear face 71, a side face 72, a top face 73, and a bottom face 74 that together define an exterior of the bull-nose portion. The bottom face 74, although not visible in FIG. 1A, is a mirror of the top face 73. Note that the top face 73 and the bottom face 74 are both examples of the shape of a cross-section of the bull-nose portion and so it is apparent that a cross-section of the bull-nose portion taken parallel to these faces would be generally triangular in shape, but wherein at least one of the three edges of the triangle is defined by a curve instead of a straight line. In the embodiment shown in FIG. 1A, the curve edge of the cross-section is the curve that makes up the bull-nose front face 70. The other two edges of the triangle are the first rear face 71 and the side face 72.

The first mounting block portion 14 comprises a generally flat planar second rear face 75 extending generally perpendicular to the first rear face 71 of the bull-nose portion, and a generally flat planar front face 76 extending generally parallel to the planar second rear face 75. The bull-nose portion 12 attaches to the first mounting block portion 14, the generally flat planar first rear face 71 abutting the generally flat planar second rear face 75 and thereby forming a first back side 78 having a wrap-around angle 77. The wrap around angle 77 wraps the bull-nose glide 10 around either the latch side or the latch post, depending on which of the two the bull-nose glide 10 is mounted. The first back side 78 comprises the generally flat planar first rear face 71, the wrap around angle 77, and the generally flat planar second rear face 75. Note also that FIG. 1A illustrates the curved bull-nose front face 70 smoothly transitioning into the planar front face 76.

Figure 3:
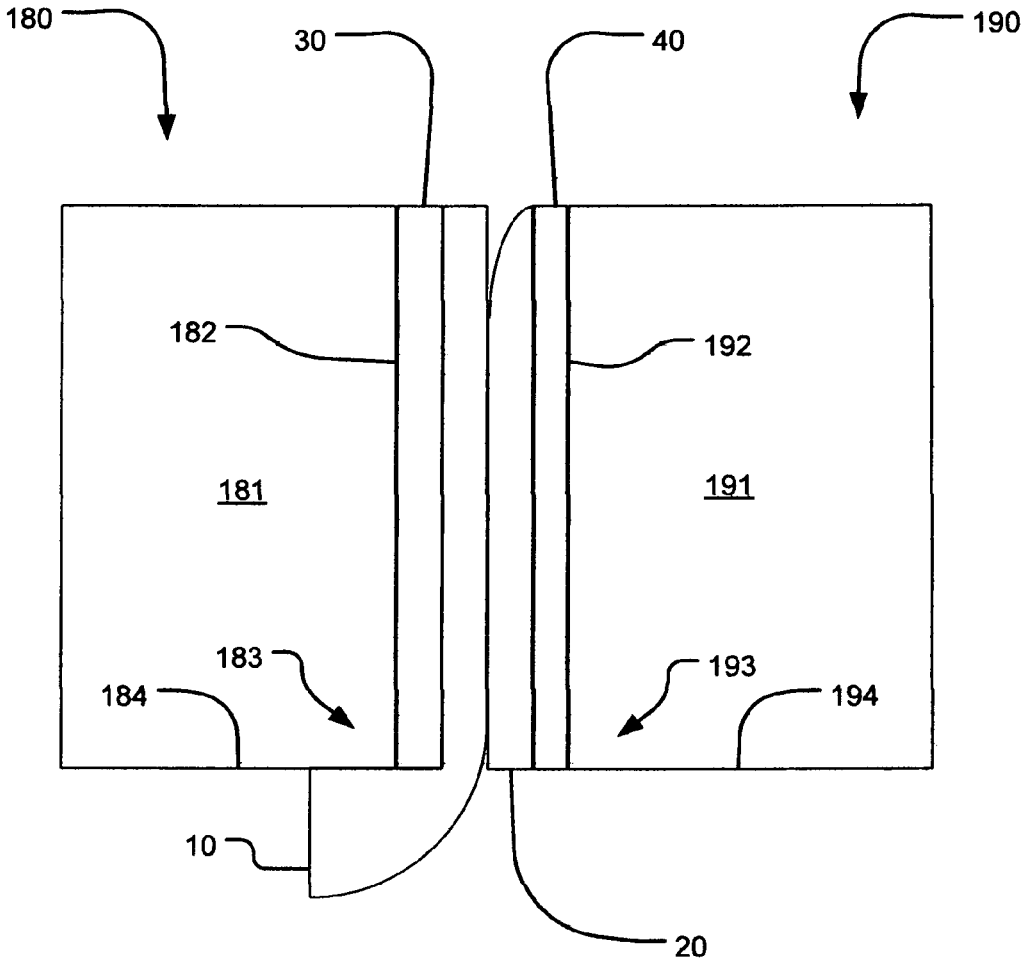
FIG. 3 illustrates a top plan view of an exemplary embodiment of a gate adjustment system installed on a gate.

The planar second rear face 75 is adapted to mount the first mounting block portion 14 to one of the latch post and the latch side. In FIG. 3, the latch post 180 has two latch post faces 182 and 184. The first latch post face 182 faces the latch side 190. The latch side 190 has two latch side faces 192 and 194. The first latch side face 192 faces the latch post 180. If the first mounting block portion 14 is to be mounted to the latch post, it is adapted to mount to the first latch post face 182 and the first rear face 71 then aligns with the second latch post face 184. If the first mounting block portion 14 is to be mounted to the latch side, it is adapted to mount to the first latch side face 192 and the first rear face 71 then aligns with the second latch side face 194.

Figure 1B:
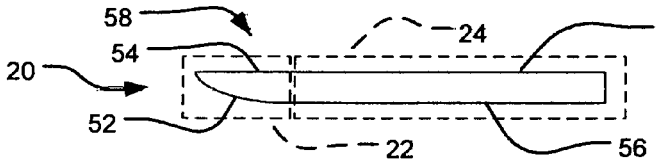

The flat glide 20 has a curved portion 22 and a second mounting block portion 24. The curved portion 22 has a curved front face 52 and a generally flat planar third rear face 54. The second mounting block portion has a generally flat planar second front face 56 and a generally flat planar fourth rear face 55. As can be seen in FIG. 1B, the third rear face 54 abuts the fourth rear face 55 and together, they form a generally flat planar second back side 58. Note also that FIG. 1B shows the smooth transition of the curved front face 52 into the generally flat planar second front face 56.

Figure 1C:
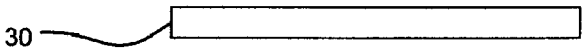
Figure 1D:
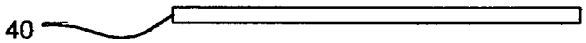

Also shown in FIGS. 1C and 1D are a plurality of spacers 30 and 40. The spacers 30 and 40 can be placed between one or both glides as they are mounted on the latch post and latch side of the gate. FIG. 1C illustrates a first spacer 30 and FIG. 1D illustrates a second spacer 40. The Figures show two spacers, in other embodiments the number of spacers can be one, two, three, or more.

Figure 1E:
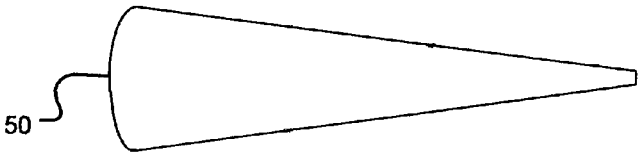

A gap adjustment wedge 50 is illustrated in FIG. 1E. The gap adjustment wedge 50 can be used in combination with the gap size gauge 60 (see FIG. 1F). As discussed above, when installing the gate adjustment system, one step is to pull the gate up and into proper alignment. This process is assisted by inserting the gap adjustment wedge 50 between the latch post and the latch side. It is preferable to place the wedge 50 between the top portions of the latch post and the latch side. The wedge 50 should be pushed downwards into the latch post gap (i.e., the space between the latch side of the gate and the latch post) until the gap is the same width down the entire length of the latch side. Once the gap has a uniform width, the gap size gauge 60 can be inserted into the gap. The gap size gauge 60 has a number of differing thicknesses that allow the user to measure the size of the gap using the gauge 60.

Figure 1F:
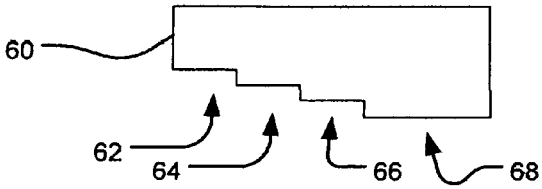

In the embodiment shown in FIG. 1F, the gap size gauge 60 has four distinct thicknesses: one-half inch, five-eighths inch, three-quarters inch, and seven-eighths inch. In other embodiments, the number of thicknesses can be 1, 2, 3, or more and they can vary in dimension from the exemplary measurements given above. In yet another embodiment, the gap size gauge 60 is continuously varying in thickness, thereby having a virtually unlimited number of thicknesses. The gap size gauge 60 can be placed within the latch post gap and the size of the gap can be thereby determined. For example, if the first thickness 62 of the gap size gauge 60 just fits within the gap, then the gap is approximately one-half inch wide; if the second thickness 64 fits within the gap, then the gap is approximately five-eighths inch wide; etc. It is contemplated that the gap size gauge can include indicia that specify the various gap size measurements.

As illustrated in the embodiment in FIGS. 1C and 1D, the plurality of spacers 30 and 40 are represented by two rectangular, three-dimensional boxes of differing thicknesses. For example, the first spacer 30 can have a thickness of approximately one-eighth inch and the second spacer 40 can have a thickness of approximately one-quarter inch. In one embodiment, the thicknesses of the first mounting block portion 14 of the bull-nose glide 10 and the second mounting block portion 24 of the flat glide 20 are both one-quarter inch (in other embodiments, other thicknesses are contemplated). Thus, the combined thickness of the two mounting blocks 14 and 24 is one-half inch. When the blocks 14 and 24 are properly mounted to the inside of latch post and the latch side so that they abut each other, they have a combined thickness of one-half inch, which allows them to fit within the preferred latch post gap of one-half inch. However, as discussed above, the gap may be larger than one-half inch, as measured using the gap size gauge 60. If the gap is five-eighths inch then the first spacer 30 can be used when mounting either the bull-nose glide or the flat glide. If the gap is three-quarters inch, then the second spacer 40 can be used. If the gap is seven-eighths inch then both spacers 30 and 40 can be employed. As discussed above, other embodiments having a different number of spacers with varying thicknesses are contemplated.

FIGS. 2A-2F each illustrate a side elevation view of a component of an exemplary embodiment of a gate adjustment system. The components shown include a bull-nose glide 10, a flat glide 20, a plurality of spacers 30 and 40, a gap adjustment wedge 50, and a gap size gauge 60. The illustrated components in FIGS. 2A-2F are the same as those shown in FIGS. 1A-1F., respectively, except that the view is a side elevation view in FIGS. 2A-2F.

The bull-nose glide 210 has a curved, bull-nose portion 212 and a first mounting block portion 214. The broken-line rectangle labeled "212" surrounds and defines the curved, bull-nose portion 212. The curved, bull-nose portion 212 is shaped so as to distribute the impact forces when the gate is closed and redirect those forces into lifting and pushing the gate back into alignment rather than just having the latch side of the gate impact, and likely bounce off of, the latch post.

Figure 2A:
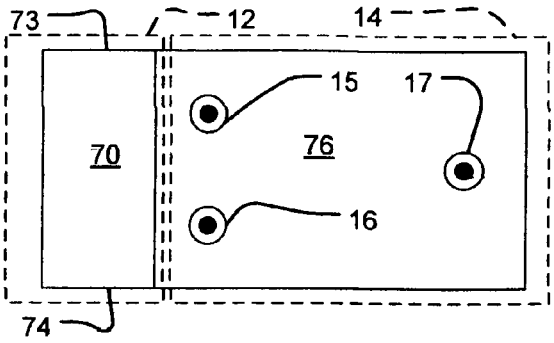
FIGS. 2A-2F each illustrate a side elevation view of a component of an exemplary embodiment of a gate adjustment system.

The broken-line rectangle labeled "14" surrounds and defines the first mounting block portion 14 of the bull-nose glide 10. The first mounting block portion 14 is placed against either the inside of the latch post or the inside of the latch side of the gate and affixed thereto. Exemplary placement of the bull-nose glide 10 on a gate assembly can be seen in FIG. 3. Also illustrated in FIG. 2A is an exemplary means of mounting the bull-nose glide 10: holes for mounting screws are depicted and labeled 15, 16, and 17. In other embodiments, other numbers and locations of mounting holes are contemplated as are other mounting means besides holes and screws.

Operating in concert with the bull-nose glide 210 is the flat glide 220. The flat glide 220 has a curved portion 222 and a second mounting block portion 224. The broken-line rectangle labeled "222" surrounds and defines the curved, portion 222. The curved portion 222 is shaped so as to distribute the impact forces when the gate is closed and redirect those forces into lifting and pushing the gate back into alignment rather than just having the latch side of the gate impact, and likely bounce off of, the latch post.

Figure 2B:
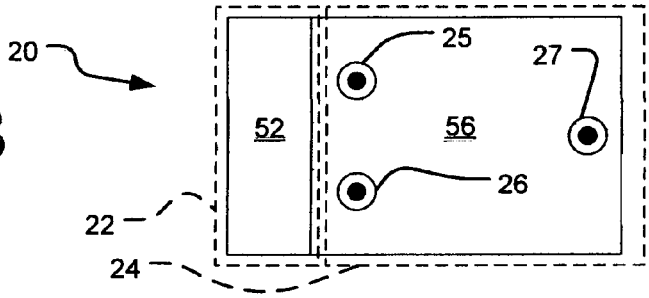

The broken-line rectangle labeled "24" surrounds and defines the second mounting block portion 24 of the flat glide 20. The second mounting block portion 24 is placed against either the inside of the latch post or the inside of the latch side and affixed thereto. Exemplary placement of the flat glide 20 on a gate assembly can be seen in FIG. 3. Also illustrated in FIG. 2B is an exemplary means of mounting the flat glide 20: holes for mounting screws are depicted and labeled 25, 26, and 27. In other embodiments, other numbers and locations of mounting holes are contemplated as are other mounting means besides holes and screws. For example, mounting options can include adhesives, nails, bolts, etc.

Figure 2C:
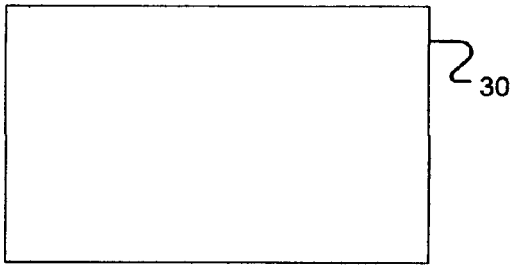
Figure 2D:
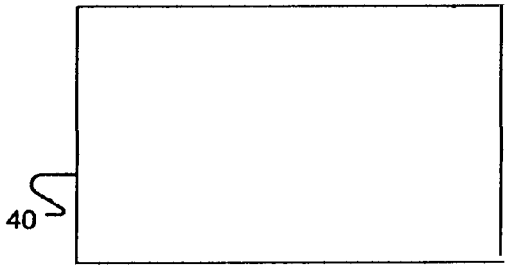

A plurality of spacers 30 and 40 are illustrated in the embodiment shown in FIGS. 2C and 2D. The spacers 30 and 40 can be placed between one or both glides as they are mounted on the latch post and latch side of the gate. FIGS. 2C and 2D show two spacers (a first spacer 30 in FIG. 2C and a second spacer 40 in FIG. 2D), in other embodiments the number of spacers can be one, two, three, or more. The spacers serve to fill in excess space for installations in which the gap size (between the latch side of the gate and the latch post) is overly large.

Figure 2E:
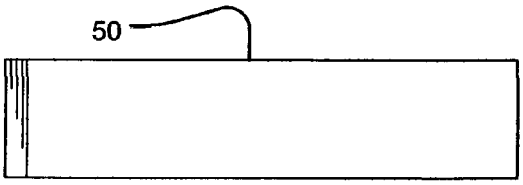

A gap adjustment wedge 50 is illustrated in FIG. 2E. The gap adjustment wedge 50 can be used in combination with the gap size gauge 60 (see FIG. 2F). As discussed above, when installing the gate adjustment system, one step is to pull the gate up and into proper alignment. This process is assisted by inserting the gap adjustment wedge 50 between the latch post and the latch side. It is preferable to place the wedge 50 between the top portions of the latch post and the latch side. The wedge 50 should be pushed downwards into the latch post gap until the gap is the same width down the entire length of the latch side. Once the gap is uniform, the gap size gauge 60 can be inserted into the gap. The gap size gauge 60 has a number of differing thicknesses that allow the user to measure the size of the gap using the gauge 60.

Figure 2F:
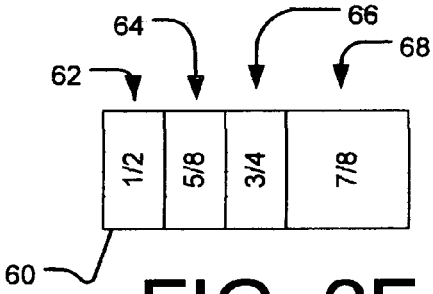

In the embodiment shown in FIG. 2F, the gap size gauge 60 has four distinct thicknesses: one-half inch, five-eighths inch, three-quarters inch, and seven-eighths inch. In other embodiments, the number of thicknesses can be 1, 2, 3, or more and they can vary in dimension from the exemplary measurements given above. In yet another embodiment, the gap size gauge 60 is continuously varying in thickness, thereby having a virtually unlimited number of thicknesses. The gap size gauge 60 can be placed within the latch post gap and the size of the gap can be thereby determined. For example, if the first thickness 62 of the gap size gauge 60 just fits within the gap, then the gap is approximately one-half inch wide; if the second thickness 64 fits within the gap, then the gap is approximately five-eighths inch wide; etc. In one embodiment, the gap size gauge 60 incorporates a number of measurement indicia in order to enhance the user's ability to quickly determine the appropriate gap size—see indicia in FIG. 2F, including: ½, ⅝, ¾, and ⅞.

As illustrated in the embodiment in FIGS. 2C and 2D, the plurality of spacers 30 and 40 are represented by two rectangular, three-dimensional boxes of differing thicknesses (see top plan view in FIGS. 1C and 1D to clearly see the varying thicknesses). For example, the first spacer 30 can have a thickness of one-eighth inch and the second spacer 40 can have a thickness of one-quarter inch. In one embodiment, the thicknesses of the first mounting block portion 14 of the bull-nose glide 10 and the second mounting block portion 24 of the flat glide 20 are both one-quarter inch. Thus, the combined thickness of the two mounting blocks 14 and 24 is one-half inch. When the blocks 14 and 24 are properly mounted to the inside of latch post and the latch side so that they abut each other, they have a combined thickness of one-half inch, which allows them to fit within the preferred latch post gap of one-half inch. However, as discussed above, the gap may be larger than one-half inch, as measured using the gap size gauge 60. If the gap is five-eighths inch then the first spacer 30 can be used when mounting either the bull-nose glide or the flat glide. If the gap is three-quarters inch, then the second spacer 40 can be used If the gap is seven-eighths inch then both spacers 30 and 40 can be employed. As discussed above, other embodiments having a different number of spacers with varying thicknesses are contemplated. Furthermore, the plurality of spacers 30 and 40 could have identifying width indicia on them in order to help the user identify which spacers to use based on the measured gap size.

In some installations, it is contemplated that the gap size may be less than one half inch. If this is the case, the posts, gate and/or hinges may need to be adjusted in order to increase the gap to one half inch or more. Alternatively, either or both of the latch side of the gate or the latch post can have material removed therefrom in order to accommodate the system components therebetween.

FIG. 3 illustrates a top plan view of an exemplary embodiment of a gate adjustment system installed on a gate. The gate components depicted are the latch post 180 and the latch side 190. Note that in this top plan view, only the latch post top face 181 and the latch side top face 191 are fully displayed. Nevertheless, the latch post inner face 182 and latch post side face 184 are labeled as are the latch side inner face 192 and latch side outer face 194. The latch post inner face 182 abuts the latch post outer face 184, the angle therebetween being the latch post angle 183. Similarly the latch side inner face 192 abuts the latch side outer face 194, the angle therebetween being the latch side angle 193. In the exemplary embodiment of FIG. 3, the bull-nose glide 10 is installed with a thicker first spacer 30 against the latch post 90. The flat glide 20 is installed with a second spacer 40 against the latch side 92. The gate is shown a closed position. In other embodiments, the glides 10 and 20 can be installed with fewer (e.g., zero or one) or three or more spacers. Note that as described above, in other embodiments, the bull-nose glide 10 can alternatively be mounted to the latch side 190 and the flat glide 20 can be mounted to the latch post 180.

It is to be understood that the system can be embodied in various sizes having various dimensions besides those shown in the accompanying figures. For example, the system could be built for 2×4 gates, 4×4 gates, 2×6 gates, smaller gates, larger gates, etc. Furthermore, although FIG. 3 depicts installation of the system components so that they are abutting, the system can be installed with a certain amount of play between one or more of the components (for example, between the two glides). For example, the embodiment described in FIGS. 4A and 4B below, can be installed such that the compound curves of the two glides abut when the gate is closed, but the curved, bull-nose portion of each glide may not impact the opposite glide when the gate is closed. This serves to keep the gate from experiencing gate sag, while also allowing the gate to be closed and opened with minimal force.

Installation of the system can be performed on older gates that have already experienced gate sag, those that may yet experience gate sage, new gates, etc. The system can be incorporated into new gate materials so that it is built into a gate as the gate is constructed or it can be added at a later time. The gate adjustment system components can be made out of a variety of materials and are not limited to any specific materials or group of materials. Possible examples of materials include, but are not limited to: injection molded plastic, high impact materials, impact resistant materials, low friction materials, outdoor application long-life materials (e.g., ozone resistant, high/low temperature-variation resistant, water resistant, UV resistant, etc.), materials having combinations of features, etc.

Figure 4A:
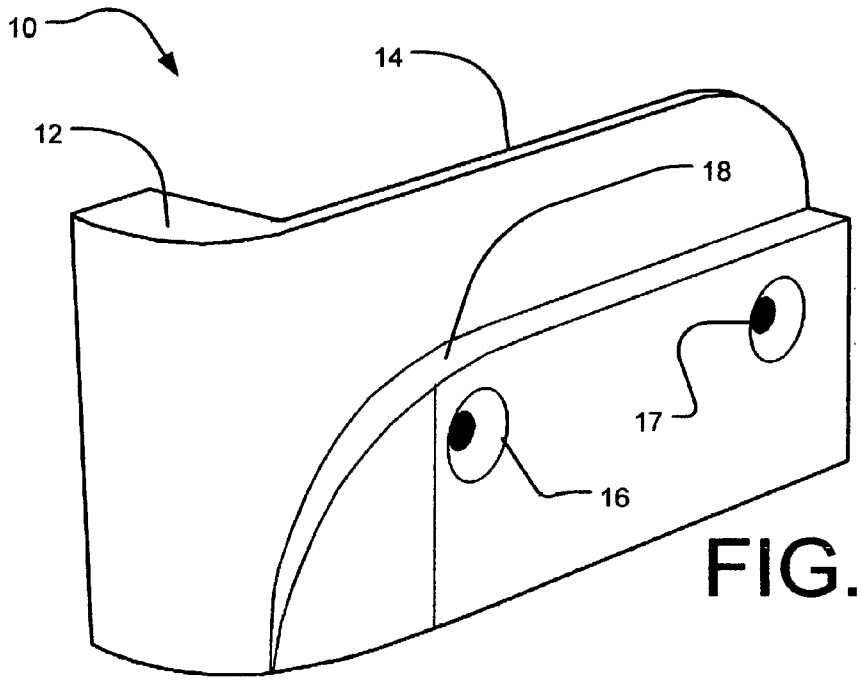
FIG. 4A illustrates a side perspective view of another embodiment of a gate adjustment system highlighting a bull-nose glide component.
Figure 4B:
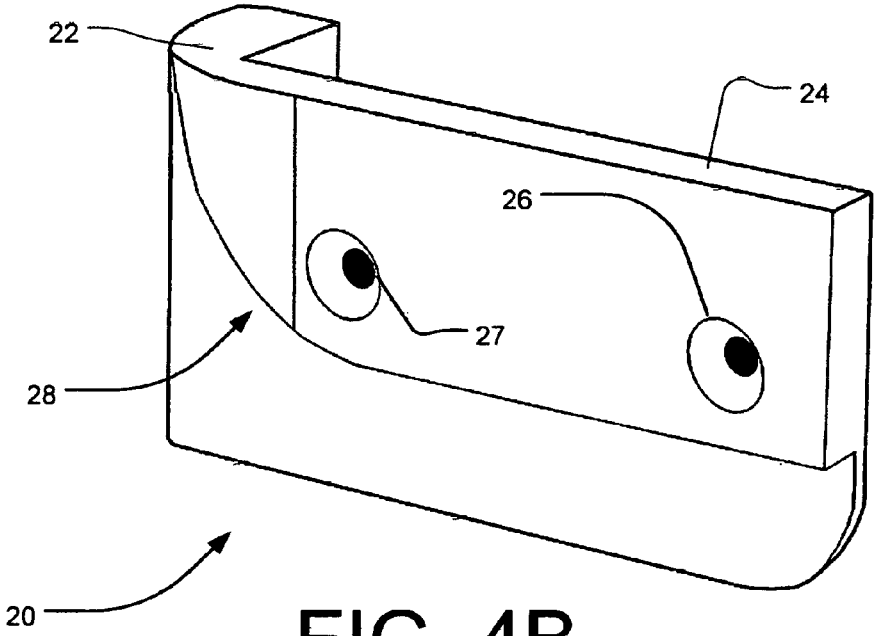
FIG. 4B illustrates a side perspective view of another embodiment of a gate adjustment system highlighted a flat glide component.

FIG. 4A illustrates a side perspective view of another embodiment of a gate adjustment system, highlighting a bull-nose glide 10. FIG. 4B illustrates a side perspective view of another embodiment of a gate adjustment system highlighting a flat glide 20. In the embodiment shown, the flat glide 20 has a similar shape, size, and appearance as the bull-nose glide 10. The bull-nose glide 10 has a curved, bull-nose portion 12 and a first mounting block portion 14. The curved, bull-nose portion 12 is shaped so as to distribute the impact forces when the gate is closed and redirect those forces into lifting and pushing the gate back into alignment rather than just having the latch side of the gate impact, and likely bounce off of, the latch post. The first mounting block portion 14 allows the bull-nose glide 10 to be securely mounted onto either the inside of a latch post or the inside of the latch side of a gate.

In the embodiment illustrated in FIGS. 4A and 4B, the flat glide 20 also has a curved, bull-nose portion 22 and a second mounting block portion 24. The curved, bull-nose portion 22 is shaped so as to distribute the impact forces when the gate is closed and redirect those forces into lifting and pushing the gate back into alignment rather than just having the latch side of the gate impact, and likely bounce off of, the latch post. The second mounting block portion 24 allows the flat glide 20 to be securely mounted onto either a latch post or a latch side of the gate.

Both glides 10 and 20 have mounting holes, shown as screw holes 16 and l7 for the bull-nose glide 10 and screw holes 26 and 27 for the flat glide 20. In other embodiments, other means of securing the glides to the mounting locations are contemplated. Furthermore, the numbers and locations of mounting holes may differ from those depicted in FIGS. 4A and 4B.

Also illustrated in FIGS. 4A and 4B are compound curves that can be added to the glides 10 and 20. The first compound curve 18 is depicted on the bull-nose glide 10 and the second compound curve 28 is depicted on the flat glide 20. As can be understood by the shapes of the various curves depicted, when properly mounted on the latch post and the latch side, the two glides 10 and 20 will impact each other when the gate is closed. First, the bull-nose portions 12 and 22 impact one another, and they serve to force the gate backwards towards the hinge side and into the correct position. Then, as the gate continues to close, the first and second compound curves 18 and 28 impact each other, causing the flat glide 20 to be lifted and forcing the gate upwards and into the correct position as the second compound curve 28 rides on top of the first compound curve 18 and the gate is fully closed.

Figure 5A:
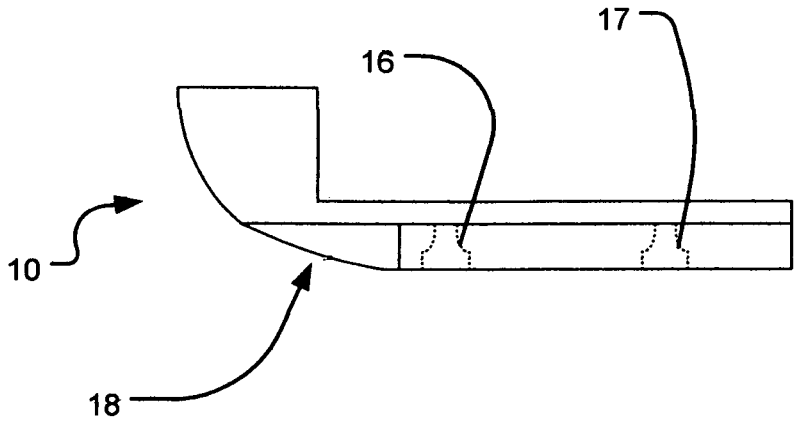
FIG. 5A illustrates a top plan view of an exemplary embodiment of a bull-nose glide.
Figure 5B:
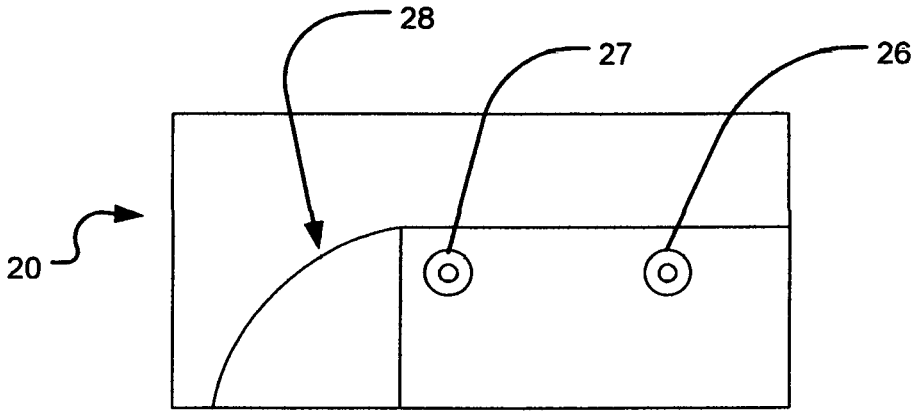
FIG. 5B illustrates a side elevation view of an exemplary embodiment of a flat glide.

FIG. 5A illustrates a top plan view of an exemplary embodiment of a bull-nose glide 510, and FIG. 5B illustrates a side elevation view of an exemplary embodiment of a flat glide 520. The relative dimensions shown in FIGS. 5A and 5B are for illustrative purposes only and show only potential embodiments—other embodiments having varying dimensions are within the scope of the invention. The compound curve elements of the embodiment shown in FIG. 4 are also depicted in FIGS. 5A and 5B.

In FIGS. 5A and 5B, the bull-nose glide 510 has a first compound curve 518 and the flat glide 520 has a second compound curve 528. Both glides 510 and 520 have mounting holes, shown in the Figures as screw holes 516 and 517 for the bull-nose glide 510 and screw holes 526 and 527 for the flat glide 520.

Figure 6A:
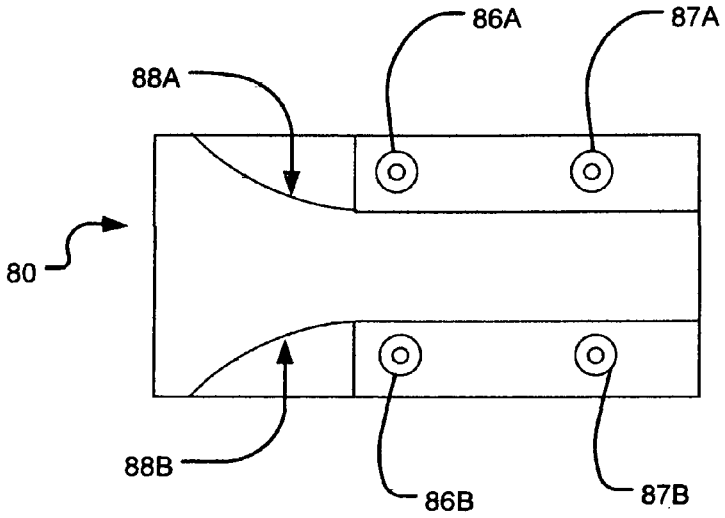
FIG. 6A illustrates a side elevation view of another embodiment of a bull-nose glide.
Figure 6B:
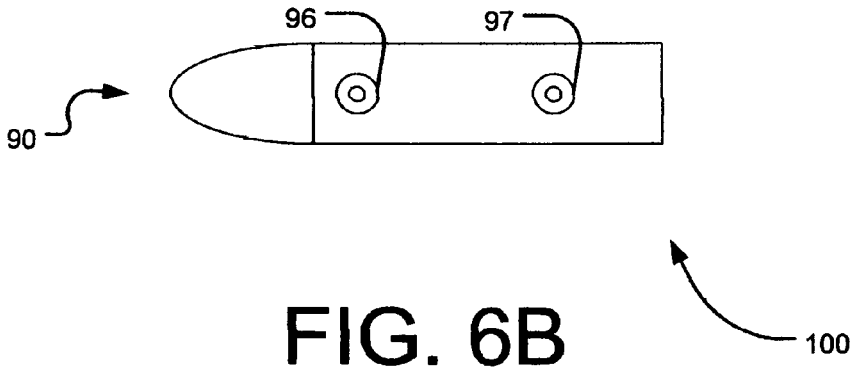
FIG. 6B illustrates a side elevation view of another embodiment of a flat glide.

FIGS. 6A and 6B illustrate various components of another exemplary embodiment of a gate adjustment system. The components illustrated include a side elevation view of an exemplary embodiment of a bull-nose glide 80, and a flat glide 90.

The embodiment of the bull-nose glide 80 in FIG. 6A has a similar bull-nose feature other embodiments, but has two compound curve features 88A and 88B—one above the other. They serve to corral the flat glide 90 between them and thus force the gate into the correct position. The flat glide 90 has a curved portion similar to that shown in FIG. 1B; however, it has two compound curve edges that work in concert with the compound curves 88A and 88B in the bull-nose glide 80 to lift the gate up or push it down and ensure it is in the correct position as the gate is swung closed. When the glides 80 and 90 are properly mounted on a gate latch side and latch post and the gate is closed, the flat glide 90 will be surrounded on three sides by the bull-nose glide 80. The relative dimensions shown in FIGS. 6A and 6B are for illustrative purposes only and show only potential embodiments—other embodiments having varying dimensions are within the scope of the invention.

The flat glide 690 is illustrated with screw holes 696 and 697. The bull-nose glide 680 is illustrated with screw holes 686A, 687A, 686B, and 687B. Other numbers and locations of screw holes are contemplated in other embodiments.

Figure 7A:
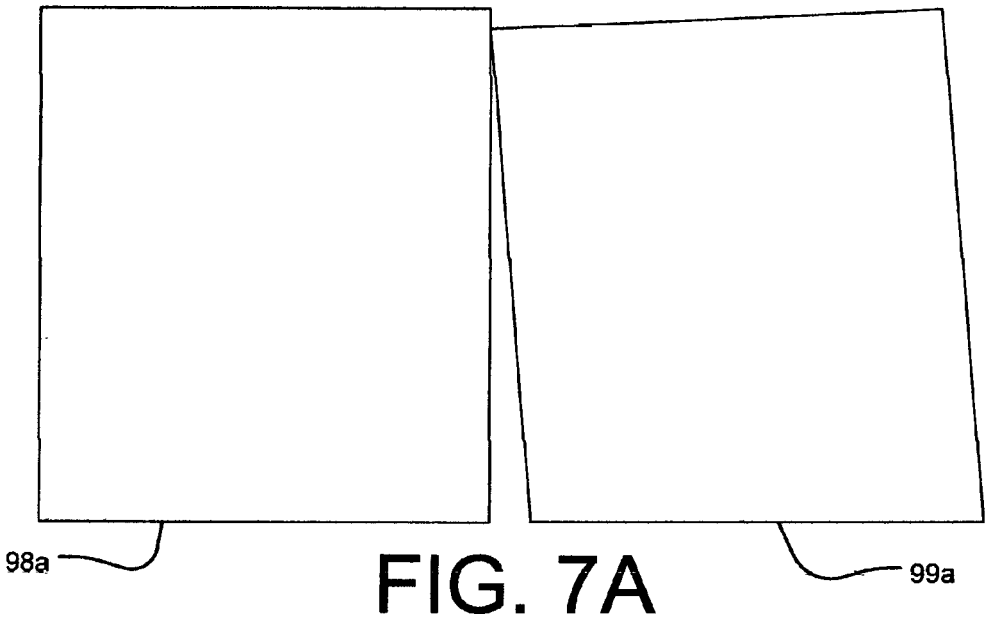
FIGS. 7A and 7B illustrate side elevation views of an exemplary embodiment of the gap adjustment wedge and gap size gauge in use.
Figure 7B:
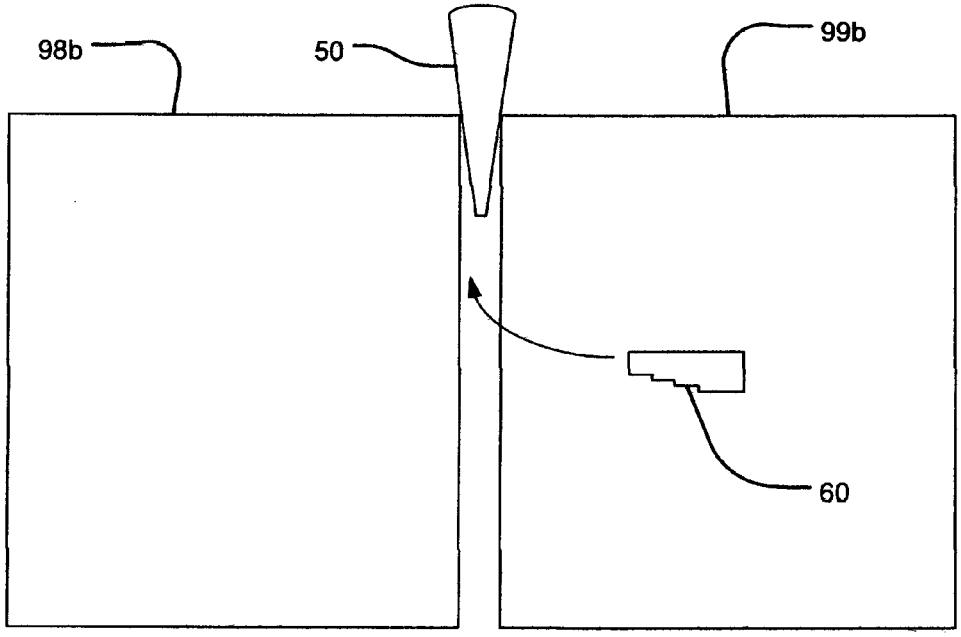

FIGS. 7A and 7B illustrate usage of the gap adjustment wedge 50 and gap size gauge 60. The top of FIG. 7A shows an exemplary embodiment of a latch post 98*a* and a latch side 99*a* wherein the gate has sagged and the latch side 99*a* is improperly impacting the latch post 98*a*. Moving to the top of FIG. 7B, the gap adjustment wedge 50 has been placed between the latch post 98*b* and the latch side 99*b* and forced the latch side 99*b* back into correct alignment creating a uniform gap between the latch side 99*b* and the latch post 98*b*. The gap size gauge 60 can then be inserted in the gap and used to measure the gap. That measurement then determines how many (if any) spacers will be needed during installation of the bull-nose glide and flat glide.

Figure 8A:
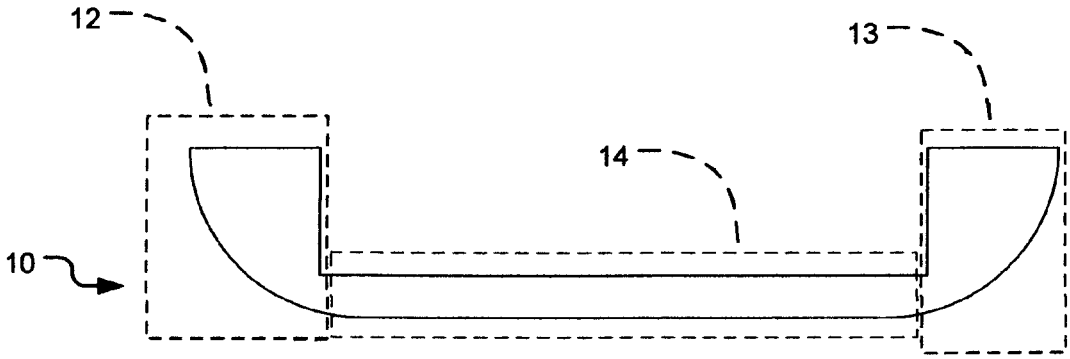
FIG. 8A illustrates a top plan view of an exemplary embodiment of a gate adjustment system highlighting a double-ended bull nose glide component.
Figure 8B:
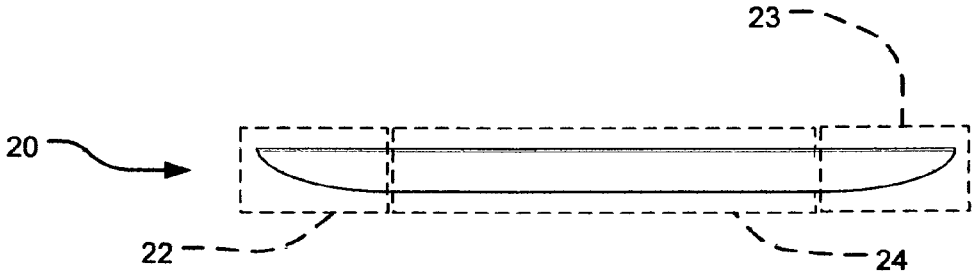
FIG. 8B illustrates a top plan view of an exemplary embodiment of a gate adjustment system highlighting a double-ended flat glide component.

FIG. 8A illustrates a top plan view of an exemplary embodiment of a gate adjustment system highlighting a double-ended bull-nose glide 10, and FIG. 8B illustrates a top plan view of an exemplary embodiment of a gate adjustment system highlighting a double-ended flat glide 20. To install the system on gates that swing both in and out, the curved, bull-nose portion 12 of the bull-nose glide 10 should be approximately duplicated as a second curved, bull-nose portion 13 on the other end of the bull-nose glide 10; the curved portion 22 of the flat glide 20 should also be duplicated as a second curved portion 23 on the other end of the flat glide 20. The bull-nose glide middle portion 14 serves to connect the two curved, bull-nose portions 12 and 13 of the bull-nose glide 10 and also rests against the flat glide 20 when the gate is closed. The flat glide middle portion 24 serves to connect the two curved portions 22 and 23 of the flat glide 20 and also rests against the bull-nose glide 10 when the gate is closed.

As can be understood from the illustrations in the Figures, in one embodiment of the system, the components can be designed such that they can be used on gates that are right-hand gates or those that are termed left-hand gates, as well as gates that swing in or out (or both). As depicted in FIGS. 8A and 8B, to install the system on gates that swing both in and out, the curved, bull-nose portion 12 of the bull-nose glide 10 should be approximately duplicated as a second curved, bull-nose portion 13 on the other end of the bull-nose glide 10; the curved portion 22 of the flat glide 20 should also be duplicated as a second curved portion 23 on the other end of the flat glide 20. It should be understood that other embodiments (including those depicted in FIGS. 1-7) can be modified in a manner similar to that in FIG. 8 such that they can be used on gates that swing both in and out The first and second mounting block portions 14 and 24 can be stretched or shrunk in length to accommodate gates and gate latch posts of various sizes.

While particular embodiments of the invention have been described and disclosed in the present application, it should be understood that any number of permutations, modifications, or embodiments may be made without departing from the spirit and scope of this invention. Accordingly, it is not the intention of this application to limit this invention in any way except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise embodiment or form disclosed herein or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

In light of the above "Detailed Description," the Inventor may make changes to the invention. While the detailed description outlines possible embodiments of the invention and discloses the best mode contemplated, no matter how detailed the above appears in text, the invention may be practiced in a myriad of ways. Thus, implementation details may vary considerably while still being encompassed by the spirit of the invention as disclosed by the inventor. As discussed herein, specific terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

The above specification, examples and data provide a description of the structure and use of exemplary implementations of the described articles of manufacture and methods. It is important to note that many implementations can be made without departing from the spirit and scope of the invention.

What is claimed is:

1. A gate adjustment system for a gate, wherein the gate has a latch side and, the latch side has a latch side inner face and a latch side outer face positioned at a latch side angle to each other, the gate is designed to be closed within a space defined by a latch post and a hinge post, and wherein the latch post has a latch post inner face and a latch post outer face positioned at a latch post angle to each other, the system comprising:

a bull-nose glide having a curved bull-nose portion and a first mounting block portion, and wherein the bull-nose portion has a curved bull-nose front face, a generally flat planar first rear face, a side face, a top face and a bottom face that together define an exterior of the bull-nose portion, said bull-nose portion having a horizontal cross-section that is generally a triangle in shape with at least one planar edge of the triangle being a curve;

the first mounting block portion having a generally flat planar second rear face extending generally perpendicular to the first rear face of the bull-nose portion, and a generally flat planar front face extending generally parallel to the planar second rear face;

wherein the bull-nose portion attaches to the first mounting block portion, the generally flat planar first rear face abutting the generally flat planar second rear face and thereby forming a first back side having a wrap-around angle;

the curved bull-nose front face attaching to the generally flat planar front face such that the curved bull-nose front face transitions into the planar front face;

a flat glide having a curved portion and a second mounting block portion, wherein the curved portion has a curved front face and a generally flat planar third rear face and the second mounting block portion has a generally flat planar second front face and a generally flat planar fourth rear face, and wherein the curved portion is attached to the second mounting block portion such that the curved front face transitions into the generally flat planar second front face and the third rear face abuts the fourth rear face, together forming a generally flat planar second back side; and wherein the first back side of the bull-nose glide is adapted to mount on the latch post inner face, the generally flat planar first rear face of the bull-nose glide is mounted on to and parallel to the latch post outer face, the wrap around angle surrounding the latch post angle and at least a portion of the curved bull-nose portion extending beyond a space defined between the latch post inner face and the latch side inner face and the second back side of the flat glide is adapted to mount opposite to the bull-nose glide on the latch side such that when the gate is swung shut, the curved bull-nose portion of the bull-nose glide first contacts and then slides against the curved portion of the flat glide thereby causing the latch side to be forced into proper alignment with the latch post.

2. The gate adjustment system of claim 1, further comprising: a plurality of spacers configured to be placed between the bull-nose glide and the latch post.

3. The gate adjustment system of claim 2, further comprising: a gap adjustment wedge having a gradually increasing thickness such that it can be placed between the latch post and the latch side and forced downwards in order to separate the latch side from the latch post and create a gap of a uniform width therebetween, and a gap size gauge having a plurality of measurements and shaped so as to fit within the gap between the latch post and the latch side of the gate.

4. The gate adjustment system of claim 1, further comprising: a plurality of spacers configured to be placed between the flat glide and the latch side.

5. The gate adjustment system of claim 4, further comprising: a gap adjustment wedge having a gradually increasing thickness such that it can be placed between the latch post and the latch side and forced downwards in order to separate the latch side from the latch post and create a gap of a uniform width therebetween, and a gap size gauge having a plurality of measurements and shaped so as to fit within the gap between the latch post and the latch side of the gate.

6. The gate adjustment system of claim 1, further comprising: a gap adjustment wedge having a gradually increasing thickness such that it can be placed between the latch post and the latch side and forced downwards in order to separate the latch side from the latch post and create a gap of a uniform width therebetween.

7. The gate adjustment system of claim 1, further comprising: a gap size gauge having a plurality of measurements and shaped so as to fit within a gap between the latch post and the latch side of the gate.

8. The gate adjustment system of claim 1, further comprising: a gap adjustment wedge having a gradually increasing thickness such that it can be placed between the latch post and the latch side and forced downwards in order to separate the latch side from the latch post and create a gap of a uniform width therebetween, and a gap size gauge having a plurality of measurements and shaped so as to fit within the gap between the latch post and the latch side of the gate.

9. The gate adjustment system of claim 1, further comprising: a plurality of spacers configured to be placed between the bull-nose glide and the latch side and a second plurality of spacers configured to be placed between the flat glide and the latch post.

10. The gate adjustment system of claim 9, further comprising: a gap adjustment wedge having a gradually increasing thickness such that it can be placed between the latch post and the latch side and forced downwards in order to separate the latch side from the latch post and create a gap of a uniform width therebetween, and a gap size gauge having a plurality of measurements and shaped so as to fit within the gap between the latch post and the latch side of the gate.

11. A gate adjustment system for a gate, wherein the gate has a latch side and a, the latch side has a latch side inner face and a latch side outer face positioned at a latch side angle to each other, the gate is designed to be closed within a space defined by a latch post and a hinge post, and wherein the latch post has a latch post inner face and a latch post outer face positioned at a latch post angle to each other, the system comprising:

a bull-nose glide having a curved bull-nose portion and a first mounting block portion, and wherein the bull-nose portion has a curved bull-nose front face, a generally flat planar first rear face, a side face, a top face and a bottom face that together define an exterior of the bull-nose portion, said bull-nose portion having a horizontal cross-section that is generally a triangle in shape with at least one planar edge of the triangle being a curve;

the first mounting block portion having a generally flat planar second rear face extending generally perpendicular to the first rear face of the bull-nose portion, and a generally flat planar front face extending generally parallel to the planar second rear face;

wherein the bull-nose portion attaches to the first mounting block portion, the generally flat planar first rear face abutting the generally flat planar second rear face and thereby forming a first back side having a wrap-around angle;

the curved bull-nose front face attaching to the generally flat planar front face such that the curved bull-nose front face transitions into the planar front face;

a flat glide having a curved portion and a second mounting block portion, wherein the curved portion has a curved front face and a generally flat planar third rear face and the second mounting block portion has a generally flat planar second front face and a generally flat planar fourth rear face, and wherein the curved portion is attached to the second mounting block portion such that the curved front face transitions into the generally flat planar second front face and the third rear face abuts the fourth rear face, together forming a generally flat planar second back side; and wherein the first back side of the bull-nose glide is adapted to mount on the latch side inner face, the generally flat planar first rear face of the bull-nose glide is mounted on to and parallel to the latch side outer face, the wrap around angle surrounding the latch side angle and at least a portion of the curved bull-nose portion extending beyond a space defined between the latch post inner face and the latch side inner face and the second back side of the flat glide is adapted to mount opposite to the bull-nose glide on the latch post inner face such that when the gate is swung shut, the curved bull-nose portion of the bull-nose glide first contacts and then slides against the curved portion of the flat glide thereby causing the latch side to be forced into proper alignment with the latch post.

* * * * *